US008261743B2

(12) United States Patent
Bachelard et al.

(10) Patent No.: US 8,261,743 B2
(45) Date of Patent: Sep. 11, 2012

(54) BREATHING APPARATUS FOR AN AIRCREW MEMBER

(75) Inventors: Leopoldine Bachelard, Chatillon (FR); Vincent Gillotin, Vauhallan (FR)

(73) Assignee: Intertechnique (FR)

( * ) Notice: Subject to any disclaimer, the term of this patent is extended or adjusted under 35 U.S.C. 154(b) by 938 days.

(21) Appl. No.: 12/297,453

(22) PCT Filed: Apr. 20, 2006

(86) PCT No.: PCT/EP2006/004586

§ 371 (c)(1),
(2), (4) Date: Oct. 17, 2008

(87) PCT Pub. No.: WO2007/121770

PCT Pub. Date: Nov. 1, 2007

(65) Prior Publication Data

US 2009/0101149 A1 Apr. 23, 2009

(51) Int. Cl.
*A62B 7/04* (2006.01)

(52) U.S. Cl. ..... 128/204.29; 128/204.26

(58) Field of Classification Search ..... 128/204.24, 128/204.26–204.29

See application file for complete search history.

(56) References Cited

U.S. PATENT DOCUMENTS

| | | | | |
|---|---|---|---|---|
| 3,526,239 | A | 9/1970 | Oroza | |
| 3,608,574 | A | 9/1971 | Beaussant | |
| 3,875,957 | A | 4/1975 | Veit et al. | |
| 4,230,097 | A * | 10/1980 | Beaussant et al. | 600/19 |
| 4,648,397 | A | 3/1987 | Beale | |
| 4,856,507 | A * | 8/1989 | Ouillon et al. | 128/204.26 |
| 5,526,804 | A * | 6/1996 | Ottestad | 128/201.25 |
| 6,701,923 | B2 * | 3/2004 | Cazenave et al. | 128/204.22 |
| 6,789,539 | B2 * | 9/2004 | Martinez | 128/204.26 |
| 6,948,498 | B2 * | 9/2005 | Cazenave et al. | 128/204.22 |
| 2003/0010340 | A1 * | 1/2003 | Martinez | 128/204.26 |
| 2003/0084901 | A1 | 5/2003 | Martinez | |

FOREIGN PATENT DOCUMENTS

| | | |
|---|---|---|
| FR | 2781381 | 1/2000 |
| FR | 2827179 | 1/2003 |

* cited by examiner

*Primary Examiner* — Fenn Mathew

(74) *Attorney, Agent, or Firm* — Dean W. Russell; Kristin M. Crall; Kilpatrick Townsend Stockton LLP

(57) ABSTRACT

The invention relates to a breathing apparatus for providing a respiratory gas to a crewmember in a cabin of an aircraft, said breathable apparatus comprising an air inlet (5) for admission of ambient air in said breathing apparatus, an additional gas inlet (2) for admission of additional gas in said breathing apparatus, an outlet nozzle (4) for feeding said crew member with the respiratory gas comprising said ambient air and/or additional gas, said breathing apparatus further comprising neutralizing means (70, 141) for neutralizing at least partially the admission of said additional gas below a predefined cabin altitude ($Z_1$).

15 Claims, 7 Drawing Sheets

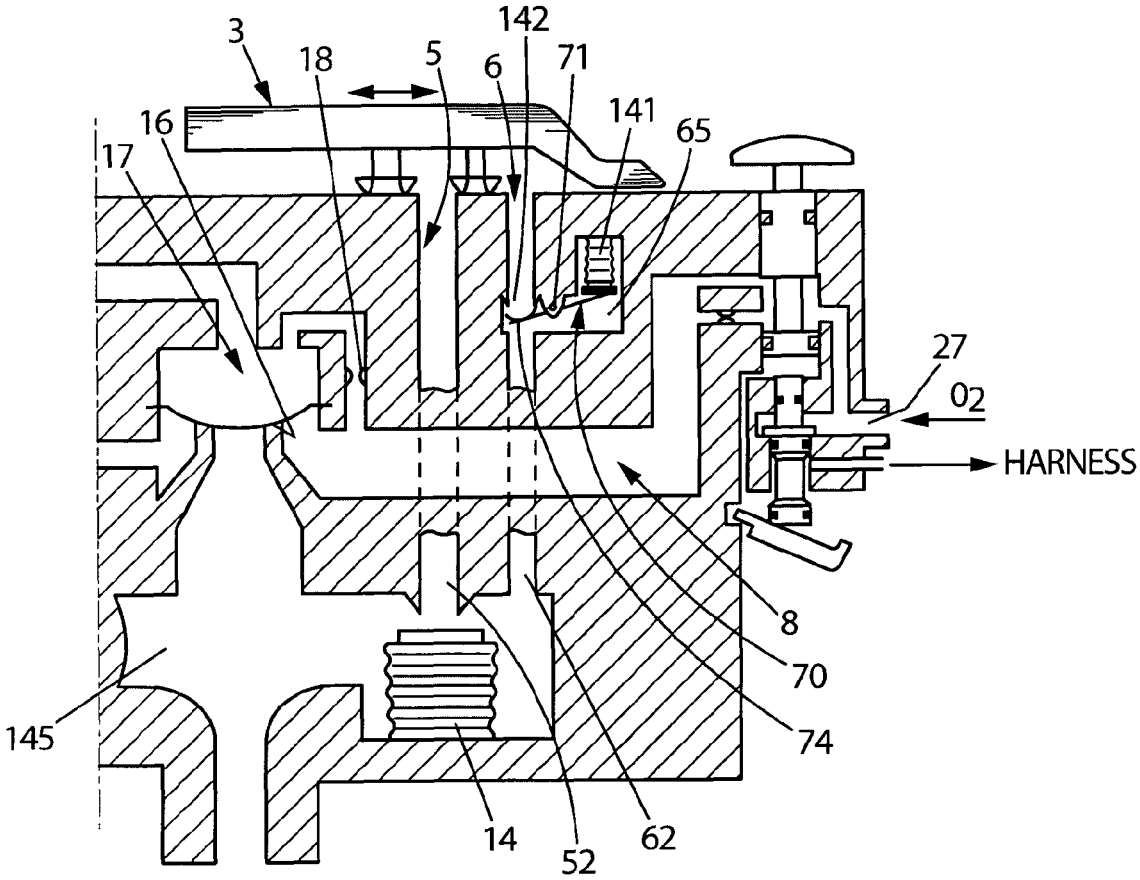
FIG. 3.1

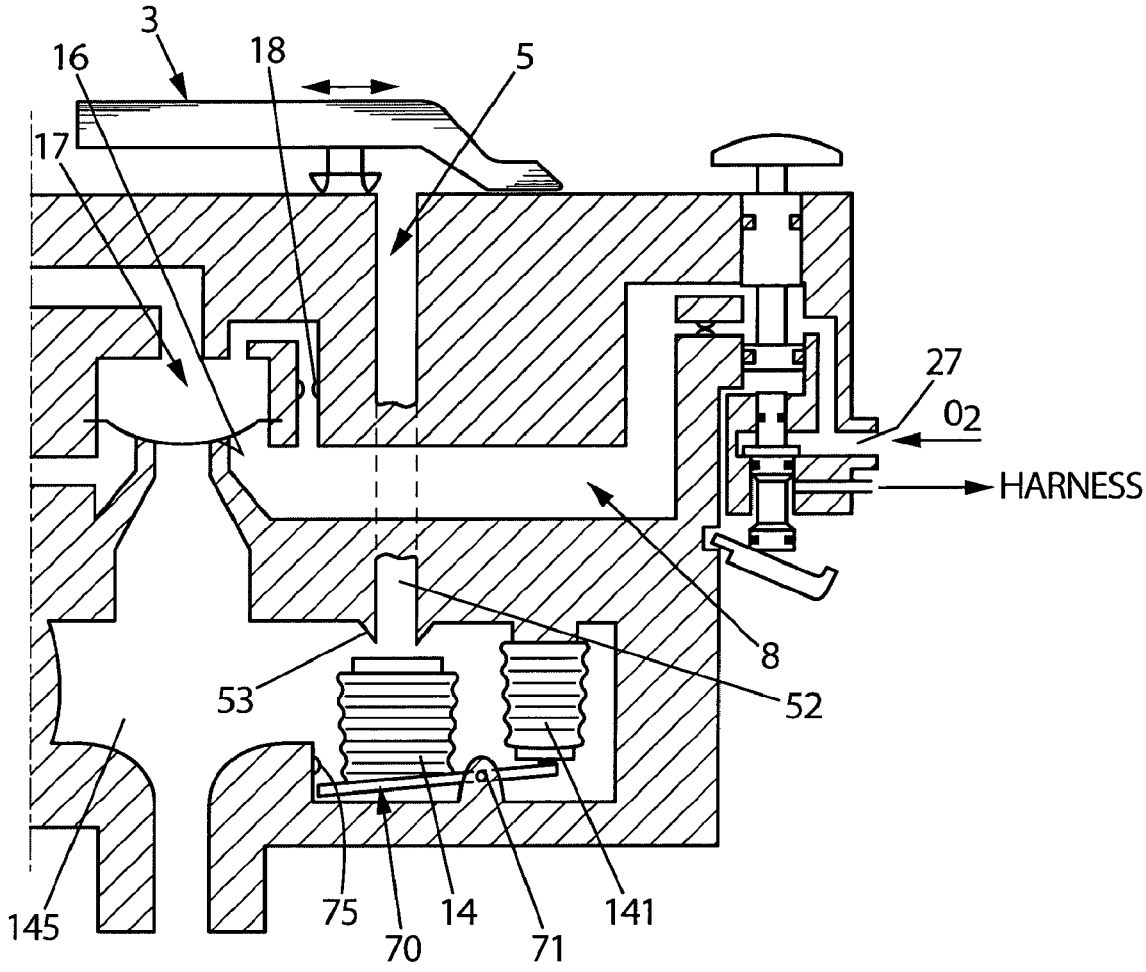
FIG. 3.2

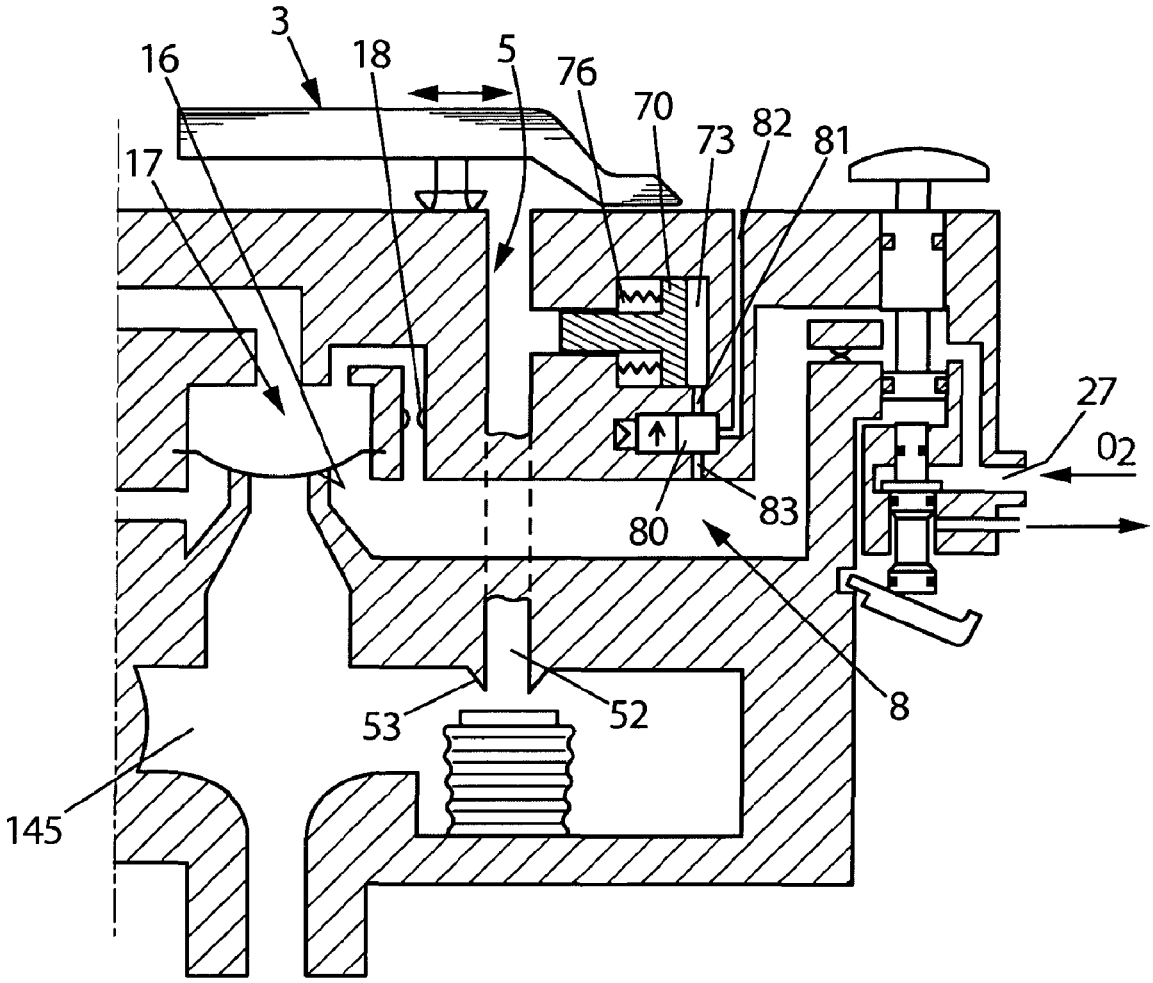
FIG. 3.3

FIG. 4.1
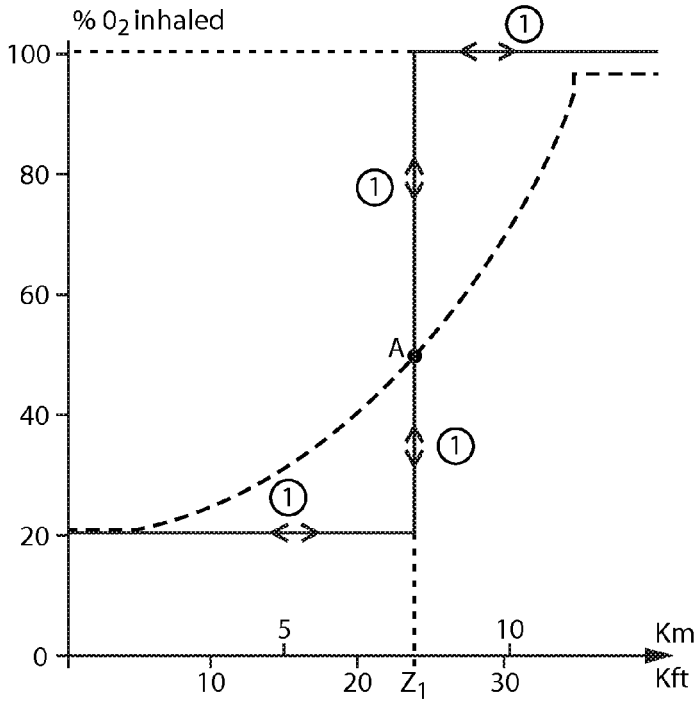
FIG. 4.2
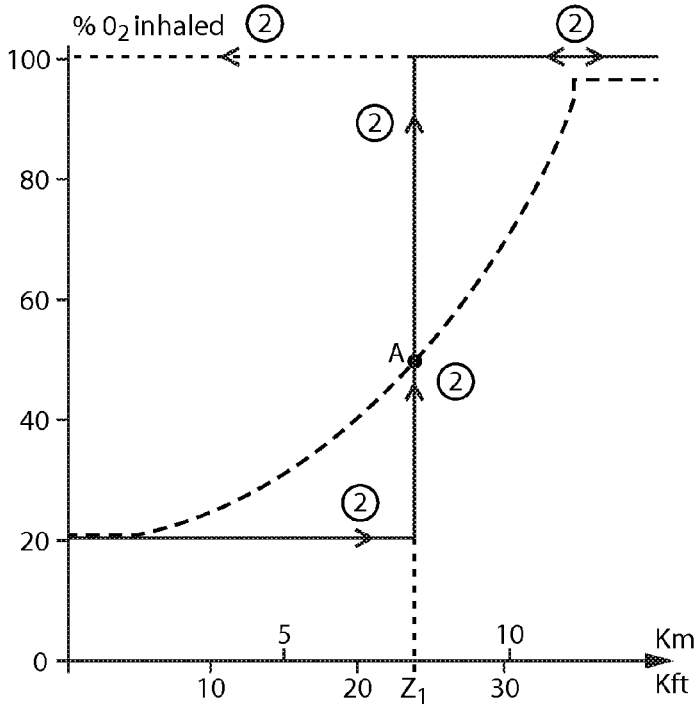

FIG. 4.3
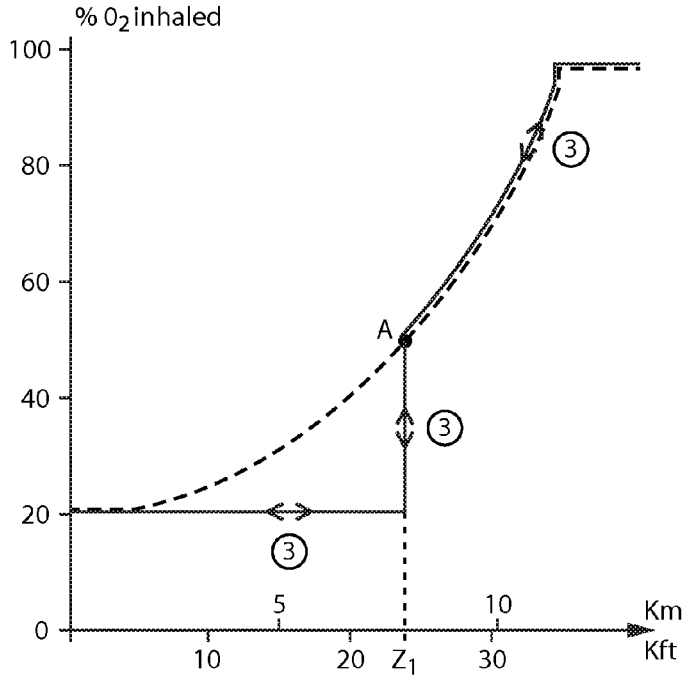
FIG. 4.4
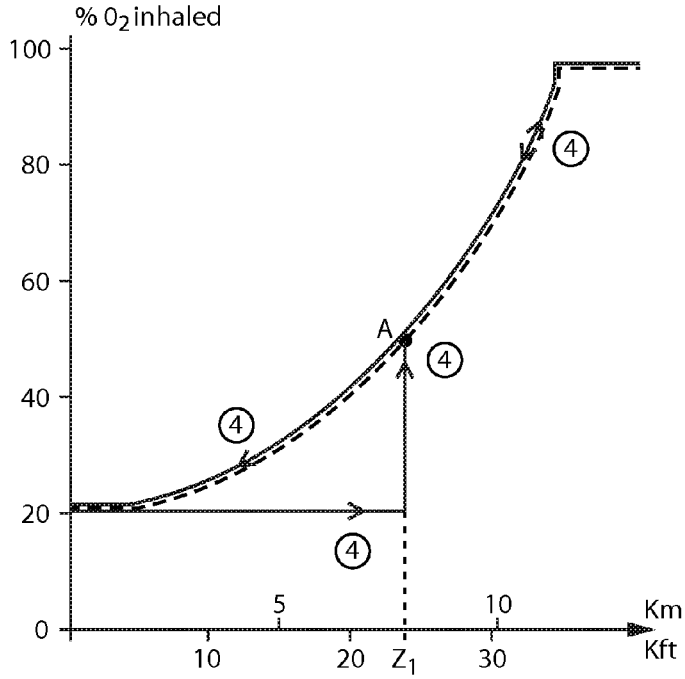

BREATHING APPARATUS FOR AN AIRCREW MEMBER

CROSS REFERENCE TO RELATED APPLICATION

This application is the U.S. national phase of International Application No. PCT/EP2006/004586 filed on Apr. 20, 2006 and published in English on Nov. 1, 2007 as International Publication No. WO 2007/121770 A1, the contents of which are incorporated herein by reference.

The present invention relates to breathing apparatus for protecting crew members, in particular the technical flight crew, of an airplane against the risks associated with depressurization at high altitude and/or the occurrence of smoke in the cockpit.

More precisely, the invention relates to a breathing apparatus for providing a respiratory gas to a crew member in a cabin of an aircraft.

Such a breathing apparatus generally comprises:

- an air inlet for admission of ambient air in said breathing apparatus,
- an additional gas inlet for admission of additional gas in said breathing apparatus,
- an outlet nozzle for feeding said crew member with the respiratory gas comprising said ambient air and/or additional gas, The breathing apparatuses are supplied, at the inlet level, with additional gas delivered by pressurized oxygen cylinders, chemical generators, or On-Board Oxygen Generator System (OBOGS) or more generally any sources of oxygen. The known breathing apparatuses may generally comprise a mask and a regulator for regulating the supply in respiratory gas.

Such breathing apparatuses are known for example from patent applications FR 2,781,381 or FR 2,827,179 which describe a breathing mask provided with a demand regulator. The known regulators deliver a respiratory gas for which the oxygen enrichment must always be greater than the minimum physiologically required enrichment that depends upon the aircraft cabin altitude, as seen in dashed-line curve in FIG. 1. By cabin altitude, one may understand the altitude corresponding to the pressurized atmosphere maintained within the cabin, thus the cabin altitude is equivalent to the cabin pressure. This value is different than the aircraft altitude which is its actual physical altitude.

In pressurized aircrafts, from a given altitude depending upon the type of aircrafts, the pressure within the cabin is maintained at a given value P, while the pressure level outside the airplane decreases with the altitude. When a pressure difference $\Delta P$ has been reached between the cabin and the outside of the aircraft, the cabin pressure is then decreased so as to decrease $\Delta P$ between the cabin and the outside of the aircraft. With a depressurization accident in an aircraft, the cabin pressure suddenly drops to the outside pressure within a matter of seconds.

In a known demand regulator, said regulator is capable of administrating the required respiratory gas volume according to the wearer's demand. The control is thus function of his/her respiratory demand which may be determined by the depression consecutive to the inhalation, by the volume or flowrate of the inhaled gas, by the change in thoracic cage volume, or any suitable data representative of the wearer's demand.

If the respiratory demand is nil, so is the breathable flowrate at the same moment. Beyond a respiratory demand threshold, additional gas is admitted into the demand regulator.

In case of emergency situations, known demand regulators are generally equipped with a "normal/100%" switch that closes the ambient air admission means when moved to the 100% position. This position allows the wearer of the mask to breath only highly oxygen enriched air, or pure oxygen provided thanks to the respiratory gas.

Other types of regulators may be used, such as a continuous flowrate regulator. In such a regulator, the additional gas, i.e. oxygen, is fed continuously to the regulator, and an anti-suffocatory air intake is provided downstream the additional gas inlet that opens and let ambient air in upon reaching a given depression in the regulator.

Furthermore, for most regulators, the respiratory gas comprising ambient air and/or the additional gas is supplied to the mask as a function of the cabin altitude.

In some instances, the need in oxygen might not correspond to the one given in FIG. 1. Indeed the actual physiological needs of a crew member to ensure his safety require feeding him with pure oxygen beyond a given altitude. In other instances, for lower altitudes, it may also be interesting to feed the crewmember with ambient air as its content in oxygen is sufficient to ensure the wearer's needs.

The known regulators, specifically the demand regulators, are robust and reliable, and can be made in a relatively simple matter. However in order to be able to comply under all operating conditions with the oxygen minimum intake as seen in FIG. 1, the security margins taken for their dimensioning lead to the result that over a major portion of their operating range, they draw pure oxygen at the rate that is well above the rate that is absolutely necessary. The consequences are direct in terms of onboard volume of oxygen that the aircraft needs to carry in excess of real physiological needs, or else it requires the presence of oxygen sources of performances and volumes that are higher than absolutely essential.

Furthermore, safety regulations do require a preventive wearing of the mask by at least one pilot when the aircraft is flying beyond a given altitude. Nevertheless it is not essential up until a second given altitude that the mask is fed with oxygen.

Therefore the flow of respiratory gas delivered to the regulator, and consequently the breathing apparatus, is too high relative to the requirements and is the cause of the excessive consumption of said respiratory gas.

An object of the present invention is to provide a breathing apparatus that does not present the drawbacks from the known apparatuses. A further object of this invention is to make available a breathing apparatus with which it is possible to reduce the supply in additional gas while still respecting the aviation regulations.

To this end, there is provided a breathing apparatus as the known breathing apparatuses, and further comprising neutralizing means for neutralizing at least partially the admission of the additional gas below a predefined cabin altitude.

Thanks to the neutralization means, as long as the cabin is maintained pressurized, the wearer only breathes in ambient air whose content in oxygen is sufficient. The oxygen reserves are not solicited. In case a sudden pressure drop in the cabin due to the depressurization accident, the neutralization means are deactivated and additional gas is fed to the apparatus, so that a mixture of additional gas and ambient air, if not solely additional gas, is fed to the crew member.

The above features, and others, will be better understood on reading the following description of particular embodiments, given as non-limiting examples. The description refers to the accompanying drawing.

FIG. 3.1 shows a first implementation of the breathing apparatus according to the invention;

FIG. 3.2 shows a second implementation of the breathing apparatus according to the invention, FIG. 3.3 shows a third implementation of the breathing apparatus according to the invention; and, FIGS. 4.1 to 4.4 are graphs plotting exemplary scenarios of additional gas supply as a function of the cabin altitude achievable thanks to the breathing apparatus according to the invention.

The invention will be illustrated here after for breathing apparatuses comprising a demand regulator or a continuous flowrate regulator. The invention remains suitable for any other types of breathing apparatuses.

Figure 2:
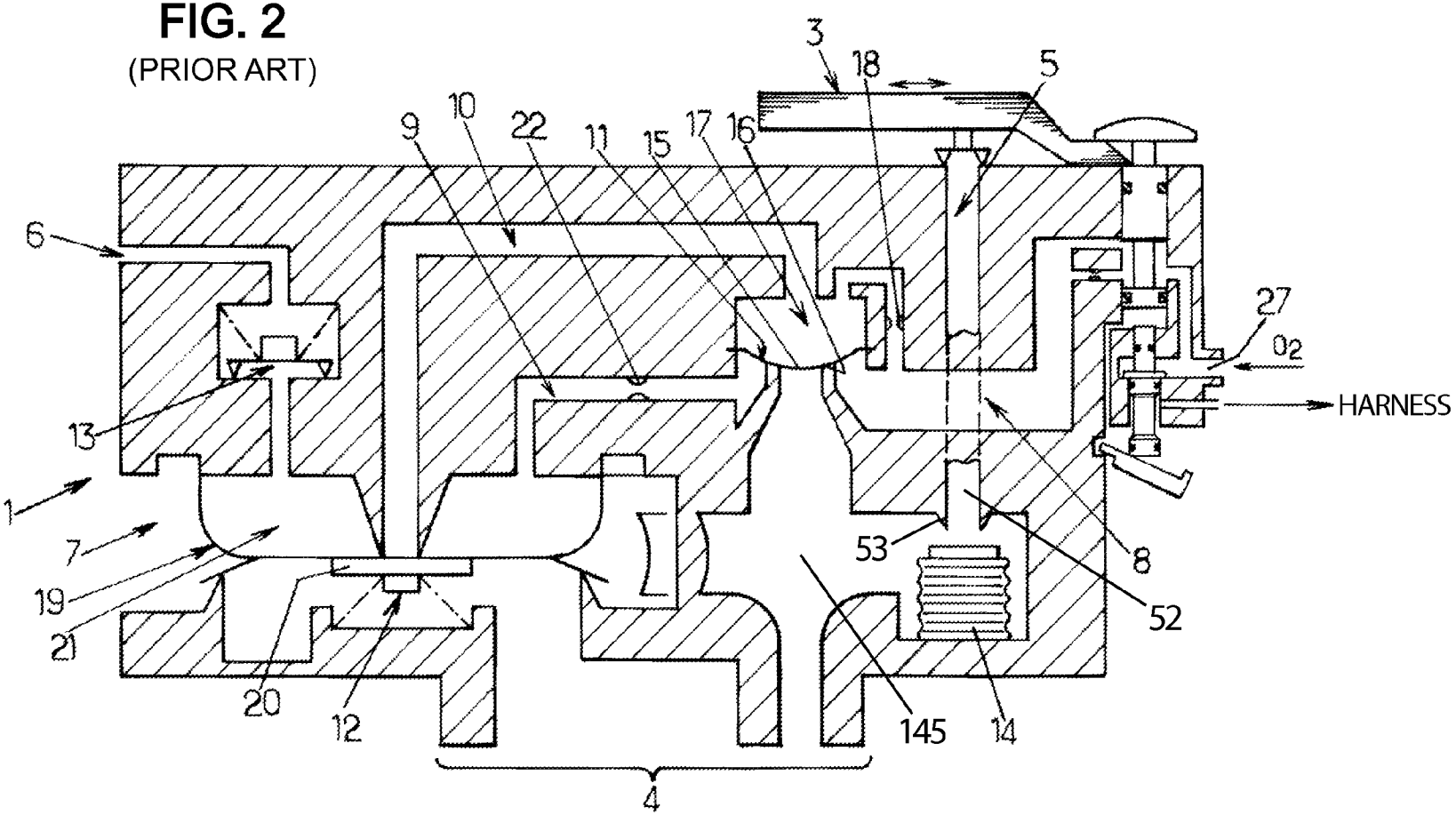
FIG. 2 (PRIOR ART)
FIG. 2 shows a known breathing apparatus.

A known breathing apparatus with a mask and a demand regulator is illustrated in FIG. 2. The regulator 1 comprises a regulator body and a "normal/100%" switch 3, shown in FIG. 2 at position "100%" (air admission closed off).

The regulator body is made up of several parts joined together and defining a circuit for fluids. It comprises several fluid communications with the outside of the regulator body: a connector piece 27 or inlet for supply/admission of additional gas, a tubing 4 connecting with the inside of a respiratory mask (not shown), an ambient air inlet 5, a passage 36 to the atmosphere, and an exhaled gases outlet 7. It also comprises an inlet 8 in communication with the additional gas supply, here pure oxygen $O_2$.

The regulator body additionally comprises several internal fluid communications: a primary conduit 9 comprising a calibrated constriction 22, and a secondary conduit 10 connecting compartments separated by a main flap valve 11 to a compartment 21 corresponding to a pilot flap valve 12.

The regulator body also comprises several switching members for modifying the circulation of the fluids in the circuit defined by the regulator body. These switching members are the main flap valve 11 and the pilot flap valve 12; the regulator shown has in addition a valve 13 for connecting the compartment 21 of the pilot flap valve 12 to the atmosphere, and an altimetric capsule 14 provided within mixing chamber 145. The mixing chamber 145 is in fluid communication with connection tubing 4.

The flap valves are of classical configuration. In the case illustrated, the main flap valve 11 is formed by a membrane 15 cooperating with a fixed seat 16. The membrane 15 separates a control chamber 17 from the inlet 8, the primary conduit 9 and the mixing chamber 145 (leading to the connection tubing 4). The control chamber 17 is connected to the inlet 8 via a calibrated constriction 18. When it is subjected to the inlet pressure of the additional gas, the membrane 15 is pressed against the seat 16, closes the passage of the additional gas in this seat 16 and separates the inlet 8 from the tubing 4.

The pilot flap valve 12 comprises a membrane 19 sensitive to the pressure. The membrane 19 carries an obturator 20 which cooperates with a fixed seat to bring the control chamber 17 into communication with the compartment 21 delimited by the membrane 19, or by contrast to separate the chamber 17 and the compartment 21. The compartment 21 also communicates with the inlet 8 via the constriction 22.

The pilot flap valve 12 also constitutes a release valve permitting escape of the exhaled gases via the outlet 7 for exhaled gases.

The pressure prevailing in the chamber 21 is limited by the venting valve 13 which ensures that the overpressure in the chamber 21 does not exceed a predetermined value.

The altimetric capsule 14 cuts off or authorizes i.e. pilots, through its length varying as a function of the altitude, the entry of air into the mixing chamber 145, via the ambient air inlet 5 and through an ambient air feed pipe 52 leading to said mixing chamber. At high altitude, the altimetric capsule 14 cuts the entry of ambient air so that the mask is supplied only with the additional gas originating from the inlet 8. To that effect, capsule 14 cooperates with a seat 53 provided on feed pipe 52 as it opens into chamber 145.

The functioning of the regulator 1 is known and is therefore not detailed here. For more details regarding its functioning, reference can be made to the documents FR-A-1 557 809 and FR-A-2 781 381.

In the breathing apparatus according to the invention, neutralizing means are provided in said breathing apparatus for neutralizing at least partially the admission of said additional gas below a predefined cabin altitude $Z_1$.

Figure 1:
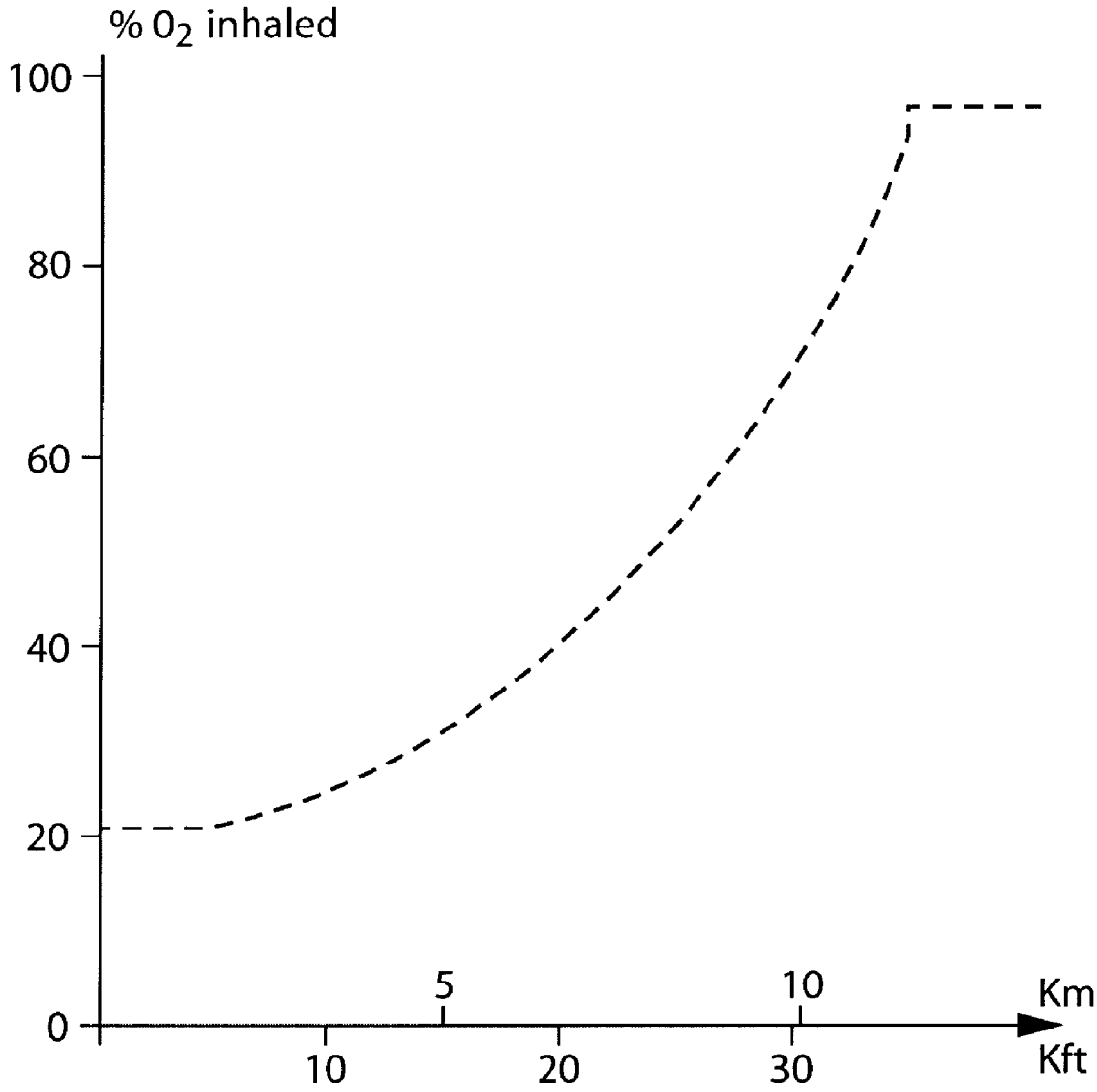
FIG. 1 is a graph plotting a typical curve for variation in oxygen minimum content as a function of the cabin altitude as required by regulations.

FIGS. 4.1 to 4.4 show examples of different scenarios of additional gas supply to the breathing apparatus according to the invention. The regulatory minimum oxygen intake (in percentage of the respiratory gas) is plotted as in FIG. 1 in dashed line.

In a first scenario presented in full line on FIG. 4.1, no oxygen is fed to the breathing apparatus up until the cabin altitude $Z_1$ is reached. The neutralizing means are activated and the inhaled oxygen corresponds to the oxygen present in the ambient air. Beyond $Z_1$, i.e. after a depressurization accident, the neutralizing means are deactivated completely, and 100% additional gas is fed to the breathing apparatus. After a depressurization accident, the pilot(s) must return the aircraft to a lower altitude which is called the diversion altitude, lower than the cruising altitude. In the first scenario, assuming the diversion altitude is low enough to ensure an ambient air rich enough in oxygen, the neutralizing means are reactivated when the plane descends below $Z_1$. This scenario is symmetrical with regards to $Z_1$.

In an alternative second scenario represented in FIG. 4.2, the neutralizing means are kept deactivated below $Z_1$ to ensure proper supply in oxygen to the crew members. This scenario is asymmetrical with regards to $Z_1$.

A third scenario is presented in full line on FIG. 4.3, no oxygen is fed to the breathing apparatus up until the cabin altitude $Z_1$ is reached. The neutralizing means are activated and the inhaled oxygen corresponds to the oxygen present in the ambient air. Beyond $Z_1$, i.e. after a depressurization accident, the neutralizing means are deactivated, and the additional gas is fed to the breathing apparatus so that at least the minimum regulatory oxygen (shown in dashed line) is supplied. As the aircraft returns to its diversion altitude (assuming the diversion altitude is low enough to ensure an ambient air rich enough in oxygen), the neutralizing means are reactivated below $Z_1$. This scenario is symmetrical with regards to $Z_1$.

In a fourth scenario alternative to the third scenario and represented in FIG. 4.4, the neutralizing means are kept deactivated below $Z_1$ to ensure proper supply in oxygen to the crew members. This scenario is asymmetrical with regards to $Z_1$, and below Z1, the percentage of inhaled oxygen is at least equal to the regulatory minimum shown in dashed line.

As described hereafter, the neutralization of additional gas may be a direct neutralization by stopping the supply in said additional oxygen or indirect neutralization by reducing the pressure loss of the ambient air inlet.

In the hereafter description, the invention will be illustrated with, but not limited to, a breathing apparatus comprising a mask with a demand regulator. The man skilled in the art will easily transpose the teachings hereafter to other types of breathing apparatuses. Furthermore, the indirect neutralization of the additional gas supply will be first described.

For simplification purposes, the ambient air inlet 5, along with the ambient air feed pipe 52, are called here after the air circuit.

In the breathing apparatus according to the invention, the neutralizing means comprises an air circuit for feeding the mixing chamber 145 with the ambient air, the pressure loss of said air circuit depending upon the cabin altitude. In order to neutralize the additional gas supply, the pressure loss of the air circuit is reduced beyond the predefined cabin altitude $Z_1$. Thus the membrane 19, driving the demand in respiratory gas, is not actuated upon inhalation of the wearer unless the depression caused by the wearer inhalation is significant. In this instance the intake of additional gas is partially neutralized.

The pressure loss reduction may be achieved by providing an air circuit with an enlarged cross section area for lower cabin altitudes. The air circuit is therefore characterized by a flow area that depends upon the cabin altitude.

To achieve such varying pressure losses of the air circuit, the neutralizing means comprises a sealing element, illustrated in the form of a lever 70 in FIGS. 3.1 and 3.2, movable between a first position, which corresponds to a resting position, wherein the pressure loss of the air circuit is minimal and a second position wherein the pressure loss of the air circuit is maximal. FIGS. 3.1 and 3.2 show lever 70 is in its first position. This first position corresponds to a cabin altitude below the predefined cabin altitude $Z_1$; the section of the air circuit is maximal. Lever 70 is in its second position when the cabin altitude is beyond the predefined altitude; the section of the air circuit is then minimal.

As the regulator is only fed with ambient air, the percentage of inhaled gas additional gas is nil. This corresponds to the horizontal line in FIGS. 4.1 to 4.4 and the common stage to all 4 illustrated scenarios.

In the first implementation show in FIG. 3.1 of the demand regulator according to the invention, the section of the air circuit is increased thanks to a second ambient air inlet 6 connected to a second ambient air feed pipe 62 that opens onto mixing chamber 145. With the resulting decreased pressure loss from the air circuit, only ambient air is sucked in by the mask wearer. In order to increase the pressure loss of the air circuit beyond the given altitude $Z_1$, in case e.g. of a sudden or slow depressurization of the cabin, a neutralizing chamber 65 is provided with a lever 70.

Lever 70 is articulated around an axis 71 provided within said chamber 65. On a first end of lever 70, a seal 74 is providing, and facing a seat 142 provided on feed pipe 62 as it opens into neutralizing chamber 65. The opposite and second end of lever 70 faces a second altimetric capsule 141 provided in a recess of chamber 65.

In the first position of lever 70, the pressure loss of the air circuit is minimal.

The neutralizing means works as follows. The first altimetric capsule 141 is adapted to move the lever 70 into its second position when the cabin altitude is greater than the predefined altitude $Z_1$. Below $Z_1$, capsule 141 length is minimal and lever 70 is in its resting position, with its first end and seal 74 away from seat 142. Biasing means (not shown in FIG. 3.1), such as a spring placed between lever 70 and axis 71, may be provided to maintain lever 70 in this position. The air circuit section is large enough to ensure minimal pressure loss from this circuit: only ambient air is sucked into the mask.

When the cabin altitude increases beyond the given altitude $Z_1$, either through a sudden or slow depressurization of the cabin, the neutralizing means further neutralize, at least partially the admission of ambient air. Capsule 141 expands and pushes lever 70 second end so that lever moves towards seat 142 to its second position wherein seal 74 comes into contact with said seat 142. Lever 70 in its second position blocks any ambient air from flowing through second feed pipe 62.

In the second position of lever 70, the configuration of the demand regulator is equivalent to the configuration of the known demand regulator, such as the one shown in FIG. 2. In other words, when the lever is in its second position, the first altimetric capsule 14 pilots the entry of ambient air into the regulator as a function of the cabin altitude, and the pressure loss of the air circuit is increased.

The respiratory gas fed to the mask as seen in FIGS. 4.3 and 4.4 moves to at least point A which corresponds to the minimum oxygen intake on the regulatory curve in dashed line. If the cabin altitude increases further, the oxygen is fed according to the minimum curve in dashed line. The third and fourth scenarios are ensured.

After a depressurization accident, the pilot(s) must return the aircraft to a lower altitude i.e. the diversion altitude of the aircraft, which is lower than the cruising altitude.

In the fourth scenario, in order to ensure an asymmetric return, the neutralization means needs to be deactivated definitively to ensure that additional gas is fed to the mask as the aircraft descends below altitude $Z_1$. Indeed, in such a descent scenario, the regulator must be fed with breathing gas to comply with the aviation regulations.

Non return means (not shown) are provided within chamber 65 so that seal 74 remains in contact with seat 142, besides altimetric capsule 141 length reducing with the altitude. The non return means may be a beveled nib with its inclined face facing lever 70 to its resting position, its flat face opposing the return of said lever in its resting position after the seal of feed pipe 62.

Switch 3 is adapted to close both air inlets 5 and 6 when switched to the 100% position.

FIG. 3.2 shows a second implementation of the breathing apparatus according to the invention.

To achieve an air circuit with pressure losses varying with the cabin altitude, the section of the air circuit is increased thanks to an enlarged air inlet 5 connected to an enlarged ambient air feed pipe 52. With the resulting decreased pressure loss from the air circuit, only ambient air is sucked in by the mask wearer. In order to increase the pressure loss of the air circuit beyond the given altitude $Z_1$, in case e.g. of a sudden or slow depressurization of the cabin, a lever 70 is provided within mixing chamber 145.

A sealing element, here a lever 70, is articulated around an axis 71 provided on a first wall of said chamber 145. First altimetric capsule 14 is provided on a first end of lever 70, said capsule 14 facing seat 53 provided in chamber 145. The opposite and second end of lever 70 faces a second altimetric capsule 141 provided in chamber 145, e.g. on a second wall opposed the first wall mentioned here before.

The neutralizing means works as follows. Below the given altitude $Z_1$, capsule 141 length is minimal and lever 70 is in its first position or resting position, with its first end and first capsule 14 away from seat 53. Biasing means (not shown in FIG. 3.2), such as a spring placed between lever 70 and axis 71, may be provided to maintain lever 70 in this position. The air circuit section is large enough to ensure minimal pressure loss from this circuit: only ambient air is sucked into the mask.

When the cabin altitude increases beyond the given altitude $Z_1$, either through a sudden or slow depressurization of the cabin, capsule 141 expands and pushes lever 70 second end towards the second position of lever 70. Capsule 14 is moved towards seat 53.

The neutralizing means further neutralizes the admission of ambient air as follows. Non return means 75 are provided within chamber 145 so that lever 70 is maintained in its second position after second capsule 141 has expanded. This second position is such that the first end of lever 70 that carries capsule 14 is closer to seat 53 when compared to the resting position of lever 70, as seen in FIG. 3.2. This ensures an increase in the pressure loss of the air circuit, resulting in a functioning of the demand regulator similar to the known demand regulator of FIG. 2. Indeed, capsule 14 length also expands due to the depressurization. Depending on the aircraft altitude, capsule 14 may eventually come into contact with seat 53 and block any ambient air from flowing through feed pipe 52. With this position of lever 70, the air circuit is closed, and only the respiratory gas is fed to the regulator.

As mentioned before with the first implementation of the regulator according to the invention, the non return means may be a beveled nib with its inclined face facing lever 70 in its resting position, its flat face opposing the return of said lever to its resting position after the seal of feed pipe 52. The asymmetrical fourth scenario is thus achieved.

In the illustrated implementations, lever 70 is actuated through a capsule 141, i.e mechanical means. In an alternative implementation, capsule 141 may be replaced by a piston, e.g. an annular piston, subjected to the pressure difference between the atmospheric pressure and the pressure that exists inside a piston chamber. An additional remotely-controlled valve (for instance a solenoid valve) serves to connect the piston chamber either to the atmosphere or else to the pressurized respiratory gas. The remotely-controlled valve thus serves to vary the pressure losses of the air circuit. When the piston chamber is connected to the atmosphere, a spring holds the piston in a position wherein the lever 70 is not actuated, and hence kept in its first position. When the chamber is connected to the pressurized source of respiratory gas, the piston presses against the lever 70 which is moved towards its second position. The electrically controlled valve may be controlled through an electronic circuit that receives a reading of the cabin altitude through a pressure or altimeter sensor. The piston chamber is thus connected to the atmosphere when the cabin altitude is below $Z_1$ and connected to the respiratory gas source beyond $Z_1$.

If the fourth asymmetrical scenario may be achieved through the here above piston (through maintaining its second position during the aircraft descent), the use of a piston driven by an electrically-controlled valve is particularly well suited when trying to achieve the third symmetrical supply scenario. Indeed, the piston allows a precise and rapid change from the first to the second position of the sealing element, and a return to the first position in the absence of non return means.

In a more general approach, a movable sealing element may be used to modify the pressure loss of the air circuit, in place of lever 70. Such a sealing element either carries the seal 74 of the first implementation of the breathing apparatus, or capsule 14 of the second implementation of the regulator. The sealing element itself may be carried by an altimetric capsule similar to capsule 141 seen in FIGS. 3.1 and 3.2 (e.g. for the fourth scenario), or the piston mentioned here before (e.g. for the third and fourth scenarios). Any other suitable altimetric device characterized by a length varying according to the cabin pressure or/and the cabin altitude may be used as well. The sealing element is further movable between a first position as defined before wherein the pressure losses of the air circuit is minimal, and a second position wherein such pressure losses are increased.

In a third implementation of the breathing apparatus according to the invention, as shown in FIG. 3.3, the sealing element comprises a piston 70. The third implementation is illustrated as a variation to the second implementation with the section of the air circuit increased thanks to an enlarged air inlet 5 connected to an enlarged ambient air feed pipe 52. An altimetric capsule 14 is used in mixing chamber 145 as with the known regulator of FIG. 2.

Piston 70 is subjected to the pressure difference between the atmospheric pressure and the pressure that exists inside a piston chamber 73. An additional electrically-controlled valve 80 (specifically a solenoid valve) is connected to chamber 73 through pipe 81 and serves to connect said piston chamber either to the atmosphere through pipe 82 or else to the pressurized respiratory gas, through pipe 83. The electrically-controlled valve 80 thus serves to vary the pressure losses of the air circuit. When the piston chamber 73 is connected to the atmosphere, as seen in FIG. 3.3, a spring 76 holds the piston in a resting position away from ambient air feed pipe 52. Its cross section is maximal, and the resulting pressure losses minimal. When the chamber is connected to the pressurized source of respiratory gas, the piston is moved towards an extended position so that it obstructs partially feed pipe 52. The pressure losses of the air circuit are increased and the regulator displays a behavior similar to the known regulators. The electrically controlled valve may be controlled through an electronic circuit (not shown) that receives a reading of the cabin altitude through a pressure or altimeter sensor. The piston chamber is thus connected to the atmosphere when the cabin altitude is below $Z_1$ and connected to the respiratory gas source beyond $Z_1$.

The electrically controlled valve 80 and the piston chamber 73 form an altimetric device that is operable as a function of the cabin altitude.

In a fourth implementation of the breathing apparatus according to the invention, the teachings of the third implementation as seen in FIG. 3.3 are transposed to the breathing apparatus with the two ambient air feed pipes described with FIG. 3.1. The second feed pipe is sealable thanks to a piston as the one here before movable between a resting position wherein the second feed pipe is open and a second position wherein the second feed pipe is sealed.

Third and fourth implementations result in a breathing apparatus which allows to follow the symmetrical fourth scenario (by returning the sealing element to its first position) and the asymmetrical third scenario (by maintaining the sealing element in its second position).

In order to achieve the first and second supply scenarios, a breathing apparatus comprising a mask and a regulator with a single air inlet may be used. Such an apparatus may correspond to the illustration of FIG. 3.3 with no altimetric capsule, and a movable piston 70 arranged to seal off totally the ambient air feed pipe. Thus, below the given altitude Z1, only ambient air is sucked in by the mask wearer. Beyond the given altitude, as the ambient air feed pipe is sealed, only additional gas is fed to the mask wearer. The symmetrical first scenario may be achieved by moving the piston back to its first position for altitude lower than Z1.

For a continuous flowrate regulator, the additional gas, the regulation means may pilot directly the supply in additional gas. A piston such as the one described here above for the third and fourth implementations may be provided along the supply line of additional gas upstream the regulator to open or seal the supply as a function of the altitude. The ambient air and the additional gas are mixed downstream the ambient air intake.

The invention claimed is:

1. A breathing apparatus for providing a respiratory gas to a crewmember in a cabin of an aircraft, said breathing apparatus comprising:

an air inlet for admission of ambient air in said breathing apparatus, an additional gas inlet for admission of additional gas in said breathing apparatus, mixing chamber for mixing the ambient air with the additional gas, an outlet nozzle for feeding said crew member with the respiratory gas comprising said ambient air and/or additional gas, a neutralizing device for neutralizing the admission of said additional gas below a predefined cabin altitude ($Z_1$), the neutralizing device comprising:

an air circuit for feeding said mixing chamber with ambient air, the pressure loss of said air circuit depending upon cabin altitude, a sealing element movable between a first position wherein the pressure loss of the air circuit is minimal and a second position wherein the pressure loss of said air circuit is increased, said sealing element being in its first position when the cabin altitude is below the predefined cabin altitude, and said sealing element being in its second position when the cabin altitude is greater than the predefined cabin altitude, a first altimetric device adapted to move the sealing element into its second position when the cabin altitude is greater than the predefined altitude, and a second altimetric device provided to pilot entry of ambient air into said apparatus as a function of the cabin altitude when the sealing element is in its second position.

2. A breathing apparatus according to claim 1, wherein the neutralizing device further neutralizes at least partially the admission of ambient air when the cabin altitude is greater than the predefined cabin altitude.

3. A breathing apparatus according to claim 1, wherein the air circuit is characterized by a flow area depending upon the cabin altitude.

4. A breathing apparatus according to claim 1, wherein the first position of the sealing element is a resting position.

5. A breathing apparatus according to claim 1, wherein the first altimetric device is an altimetric capsule.

6. A breathing apparatus according to claim 1, wherein the first altimetric device comprises a piston.

7. A breathing apparatus according to claim 1, wherein the neutralizing device further comprises non return device to maintain the sealing element in its second position even when the cabin altitude decreases and goes below the predefined cabin altitude.

8. A breathing apparatus according to claim 1, wherein the first altimetric device comprises a piston chamber and a remotely controlled valve, said remotely controlled valve driving the piston chamber pressure between a first and a second value, the sealing element being movable in response to the pressure in said piston chamber.

9. A breathing apparatus according to claim 1, wherein the second altimetric device is carried by the sealing element.

10. A breathing apparatus according to claim 1, wherein the air circuit further comprises a second air inlet and a second feed pipe, the sealing element closing said second air feed pipe in its second position.

11. A breathing apparatus for providing a respiratory gas to a crewmember in a cabin of an aircraft, said breathing apparatus comprising:

an air inlet for admission of ambient air in said breathing apparatus, an additional gas inlet for admission of additional gas in said breathing apparatus, mixing chamber for mixing the ambient air with the additional gas, an outlet nozzle for feeding said crew member with the respiratory gas comprising said ambient air and/or additional gas, a neutralizing device for neutralizing the admission of said additional gas below a predefined cabin altitude ($Z_1$), the neutralizing device comprising:

an air circuit for feeding said mixing chamber with ambient air, the pressure loss of said air circuit depending upon the cabin altitude, a sealing element movable between a first position wherein the pressure loss of the air circuit is minimal and a second position wherein the pressure loss of said air circuit is increased, said sealing element being in its first position when the cabin altitude is below the predefined cabin altitude, and said sealing element being in its second position when the cabin altitude is greater than the predefined altitude, wherein the air circuit comprises the air inlet, an air feed pipe, a second air inlet, and a second feed pipe, with the sealing element closing said second air feed pipe when the sealing element is in its second position.

12. A breathing apparatus according to claim 11, wherein the neutralizing device further comprises a device provided to pilot the entry of ambient air into said apparatus as a function of the cabin altitude when the sealing element is in its second position.

13. A breathing apparatus according to claim 11, wherein the neutralizing device further comprises a first altimetric device adapted to move the sealing element into its second position when the cabin altitude is greater than the predefined altitude, and a second altimetric device provided to pilot entry of ambient air into said apparatus as a function of the cabin altitude when the sealing element is in its second position.

14. A breathing apparatus according to claim 13, wherein the first altimetric device is an altimetric capsule.

15. A breathing apparatus for providing a respiratory gas to a crewmember in a cabin of an aircraft, said breathing apparatus comprising:

an air inlet for admission of ambient air in said breathing apparatus, an additional gas inlet for admission of additional gas in said breathing apparatus, a mixing chamber for mixing the ambient air with the additional gas, an outlet nozzle for feeding said crew member with the respiratory gas comprising said ambient air and/or additional gas, a neutralizing device for neutralizing the admission of said additional gas below a predefined cabin altitude ($Z_1$), the neutralizing device comprising:

an air circuit for feeding said mixing chamber with ambient air, the pressure loss of said air circuit depending upon the cabin altitude, a sealing element movable between a first position wherein the pressure loss of the air circuit is minimal and a second position wherein the pressure loss of said air circuit is increased, said sealing element being in its first position when the cabin altitude is below the predefined cabin altitude, and said sealing element being in its second position when the cabin altitude is greater than the predefined altitude, and a non return device to maintain the sealing element in its second position even when the cabin altitude decreases and goes below the predefined cabin altitude.

* * * * *